United States Patent [19]

Cupp et al.

[11] 4,134,173

[45] Jan. 16, 1979

[54] APPLICATOR WITH REVERSIBLE PAD

[75] Inventors: Charles D. Cupp, Lancaster; Bruce J. Matthies, Clarence Center; Frederick J. Wood, Jr., Lancaster, all of N.Y.

[73] Assignee: Shur-Line Manufacturing Co., Inc., Buffalo, N.Y.

[21] Appl. No.: 818,937

[22] Filed: Jul. 25, 1977

[51] Int. Cl.[2] ..... A46B 5/02; B25G 1/06

[52] U.S. Cl. ..... 15/210 R; 15/144 R; 15/145

[58] Field of Search ..... 15/145, 176, 210 R, 15/210 A, 220, 144 R

[56] References Cited

U.S. PATENT DOCUMENTS

| | | | |
|---|---|---|---|
| 2,955,308 | 10/1960 | Nelson | 15/210 R |
| 3,484,795 | 12/1969 | Nicolay | 15/210 R X |
| 3,591,299 | 7/1971 | Pharris | 15/210 R X |
| 3,629,894 | 12/1971 | Stefany | 15/210 R X |
| 3,631,562 | 1/1972 | Kieves | 15/172 |
| 3,690,779 | 9/1972 | Ellis | 401/287 X |
| 3,708,821 | 1/1973 | Chase et al. | 15/210 R |
| 3,717,896 | 2/1973 | Chase et al. | 15/210 R |

FOREIGN PATENT DOCUMENTS

| | | | |
|---|---|---|---|
| 2203968 | 8/1973 | Fed. Rep. of Germany | 401/207 |
| 965952 | 2/1950 | France | 15/176 |

*Primary Examiner*—Daniel Blum

*Attorney, Agent, or Firm*—Sommer & Sommer

[57] ABSTRACT

An improved applicator is adapted for use in applying a liquid coating, such as paint and the like, to an object. The improved applicator includes a handle member having a blade, and includes a reversible applicator pad having a parallelogram-shaped cushion, having a blade receiver provided on the cushion upper surface, and having bristle means provided on the cushion lower surface. The blade receiver is open at either end to receive slidable insertion of the handle blade. The blade carries a locking boss which is adapted to deform the blade receiver, and prevent unintended separation of the handle member from the pad. The position of the pad may be reversed with respect to the handle member to obtain various configurations useful in painting different objects.

1 Claim, 14 Drawing Figures

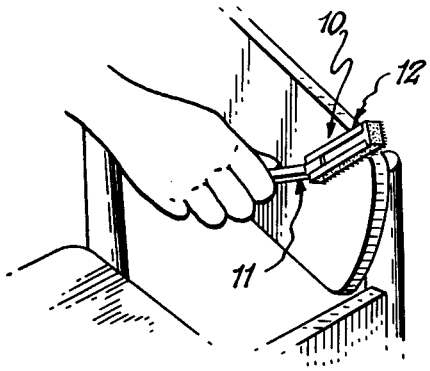
Fig. 7.
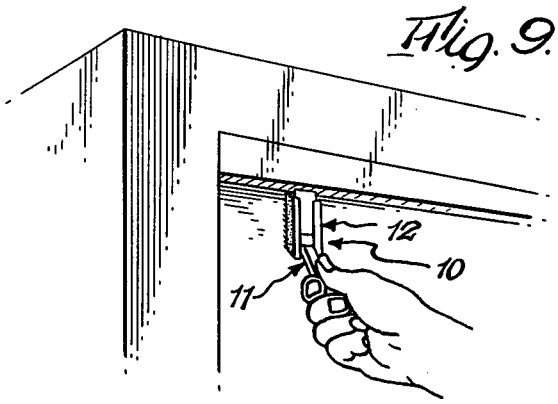
Fig. 9.
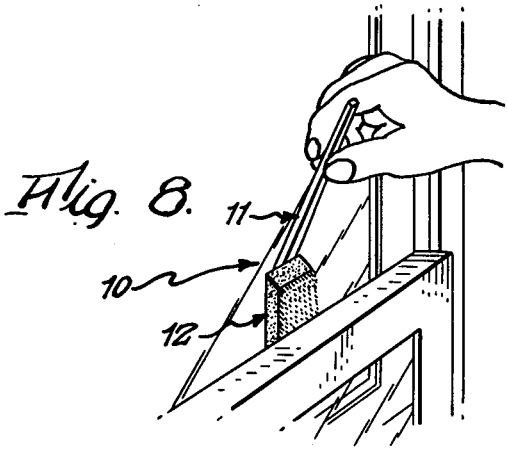
Fig. 8.
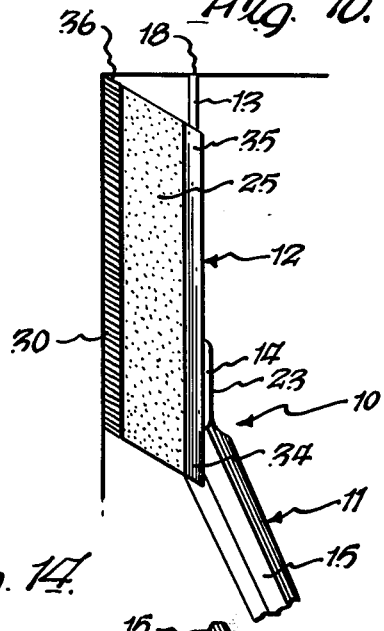
Fig. 10.
Fig. 14.
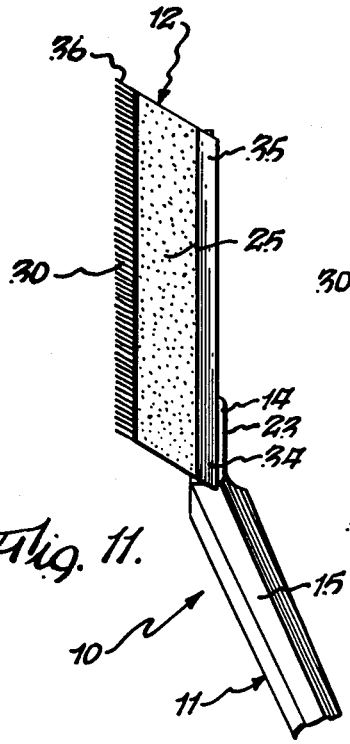
Fig. 11.
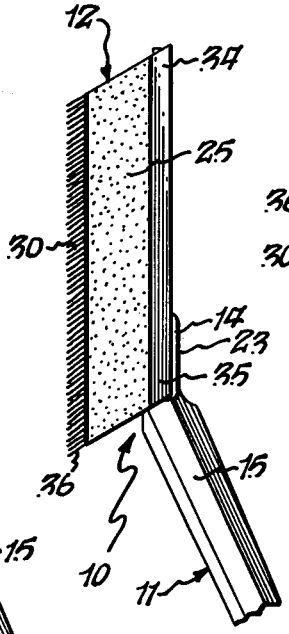
Fig. 12.
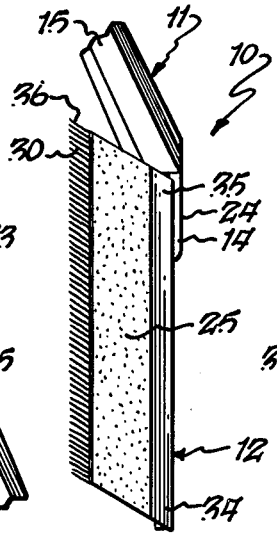
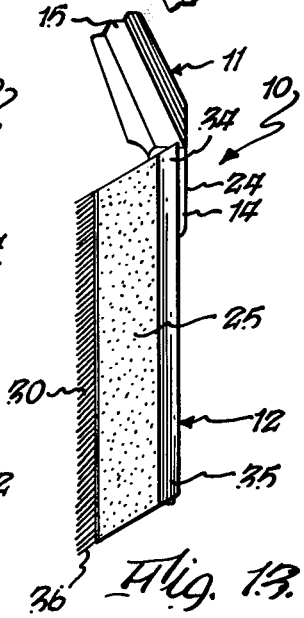
Fig. 13.

APPLICATOR WITH REVERSIBLE PAD

DESCRIPTION OF THE PRIOR ART

1. Field of the Invention

The present invention relates generally to the field of devices for applying a liquid coating, such as paint, varnish, stain or shellac and the like, to an object, and more particularly to such a coating applicator having a pad member separable from a handle member.

2. Description of the Prior Art

The most widely-known device for applying paint to an object is, of course, the conventional brush. However, in recent years, a cellular foam material has been substituted for the bristle portion of such brushes in an attempt to maintain a desirable edge.

Also, in recent years, others have developed other types of applicators having a pad which could be separated from a handle member. One example of a paint applicator having a pad and a wheeled carriage member is shown in U.S. Pat. No. 2,810,148. However, upon information and belief, no one has developed an applicator wherein the position of the pad could be reversed with respect to the handle member, particularly to afford unique operational configurations for painting different objects.

SUMMARY OF THE INVENTION

The present invention provides an improved applicator for use in applying a liquid coating, such as paint and the like, to an object.

The improved applicator broadly includes a handle member having an elongated blade from one end of which longitudinally extends an elongated and inclined handle, and also includes a reversible elongated applicator mountable on either side of the blade and frictionally held thereon in the desired relative longitudinal position pad. The applicator pad includes a cushion having upper and lower planar surfaces, and a blade receiver provided on the cushion upper surface. The blade receiver is open at both ends and is adapted to receive slidable insertion of the blade from either end. Hence, the position of the applicator pad is reversible end-for-end with respect to the handle member. The pad further includes bristle means, such as a flocked pile material, provided on the cushion lower surface, and adapted to contact the object. Since the applicator pad can be mounted on either side of the blade, the handle member including such blade may be regarded as invertible with respect to this pad.

The blade is preferably a substantially rectangular plate-like member. The blade receiver may include a web portion secured to the cushion upper surface, a flange portion extending upwardly from each of the two longitudinal margins of the web portion, and spaced inturned flange portions extending toward one another from the upper margins of the upstanding flange portions and being substantially parallel with the web. The handle member may have at least one vertically-thickened locking boss extending normally beyond the blade surface and having a surface adapted to frictionally engage the blade receiver web portion when the blade is sufficiently inserted into the slot member. In one arrangement, the blade may be inserted into the blade receiver such that a forward transverse edge of the blade will extend longitudinally beyond the bristle means for availability in use as a guide during transverse movement of the applicator pad.

Accordingly, one general object of the present invention is to provide an improved applicator having a reversible applicator pad and an invertible handle member.

Another object is to provide an improved applicator having a uniquely shaped applicator pad.

Another object is to provide an improved applicator wherein an applicator pad may be operatively attached to a handle member in a plurality of different configurations to facilitate particular painting requirements.

These and other objects and advantages will become apparent from the foregoing and ongoing written specification, the drawings and the appended claims.

BRIEF DESCRIPTION OF THE DRAWINGS

FIG. 7 is a perspective view illustrating an operator as using the improved applicator in one configuration to paint a chair.

FIG. 8 is a perspective view illustrating an operator as using another configuration of the improved applicator to paint the back of a sash of a double hung window.

FIG. 9 is a perspective view illustrating an operator as using yet another configuration of the improved applicator to paint another object, this view showing the forward transverse edge of the blade as providing a guide.

FIG. 10 is a fragmentary left side elevation of the configuration between the handle member and the applicator pad shown in FIG. 9, this view showing the applicator in use to apply a coating to a wall proximate a corner.

FIG. 11 is a fragmentary left side elevation of the improved applicator wherein the handle member blade has been slidably inserted into the rear end of the blade receiver.

FIG. 12 is a fragmentary left side elevation of the improved applicator wherein the applicator pad has been reversed end-for-end so that the handle member blade has been slidably inserted into the normally front end of the blade receiver.

FIG. 13 is a fragmentary right side elevation of the improved applicator wherein the handle member has been inverted and the blade has been slidably inserted into the rear end of the blade receiver.

FIG. 14 is a fragmentary right side elevation of the improved applicator wherein the applicator pad has been reversed end-for-end so that the handle member has been inverted and the blade slidably inserted into the normally front end of the blade receiver.

DESCRIPTION OF THE PREFERRED EMBODIMENTS

Figures 1, 2, 3, 4, 5, 6:
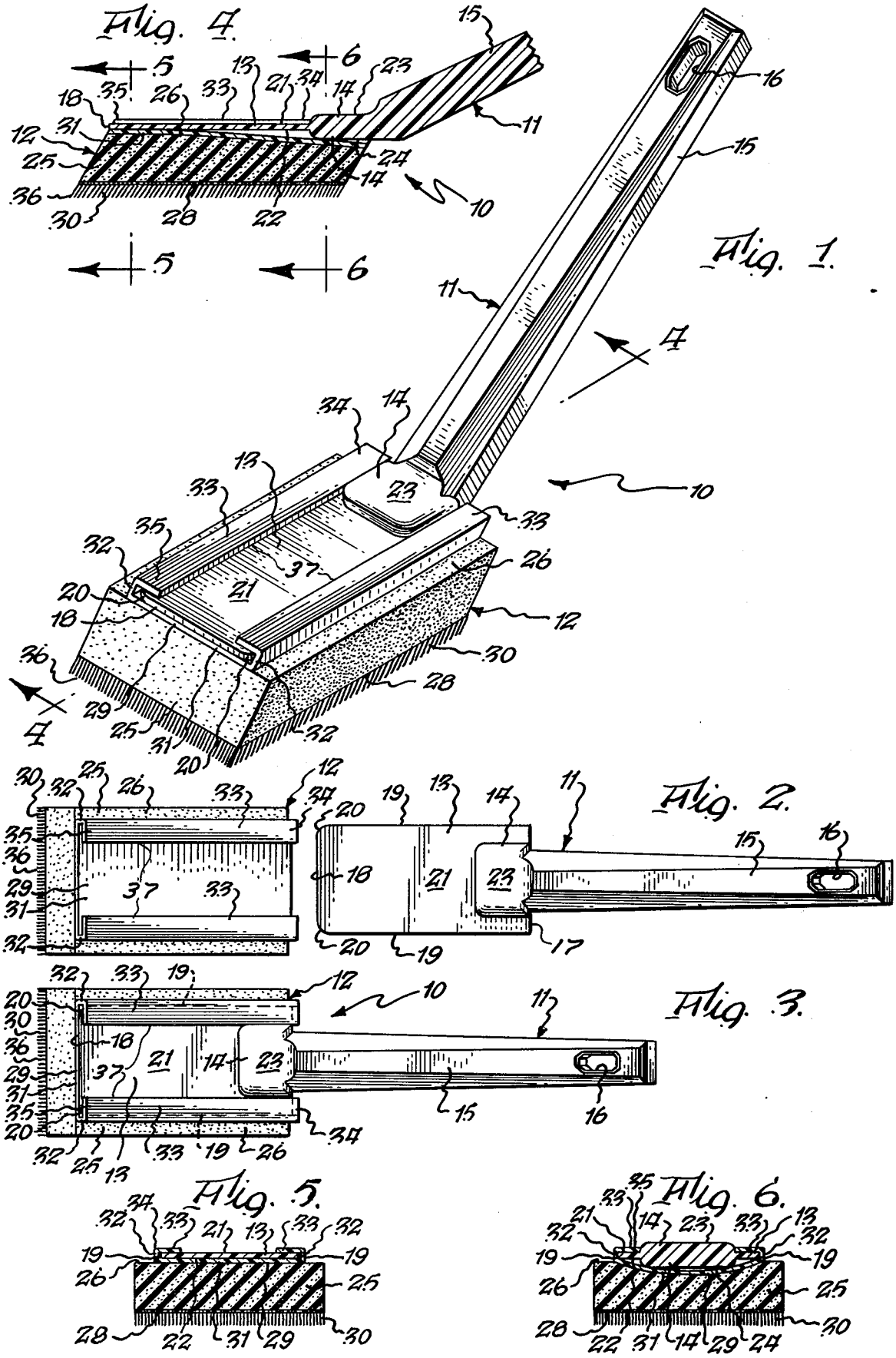
FIG. 1 is a left front perspective view of the assembled applicator showing the reversible applicator pad and invertible handle member.
FIG. 2 is a slightly reduced exploded top plan view thereof showing the position of the handle member relative to the pad, prior to insertion of the blade into the rear end of the blade receiver.
FIG. 3 is a view similar to FIG. 2, but showing the blade as having been slidably inserted into the blade receiver.
FIG. 4 is a reduced fragmentary vertical longitudinal sectional view thereof, taken generally on line 4—4 of FIG. 1, and showing the inserted lower locking boss of the handle member as deforming the rear end portion of the blade receiver and the cushion.
FIG. 5 is a fragmentary transverse vertical sectional view thereof, taken generally on line 5—5 of FIG. 4, showing the blade as being slidably received in the blade receiver.
FIG. 6 is a fragmentary transverse vertical sectional view thereof, taken generally on line 6—6 of FIG. 4, and showing the vertically-thickened lower locking boss as received in and deforming the rear end of the blade receiver.

At the outset, it should be clearly understood that like reference numerals are intended to identify the same elements and/or structure consistently throughout the several drawing figures, as such elements and/or structure may be further described by the entire written specification of which this detailed description is an integral part.

Referring initially to FIG. 1, the present invention provides an improved applicator, of which a presently preferred embodiment is generally indicated at 10, for use in applying a liquid coating, such as paint, stain, varnish, shellac and the like, to an object. While such applicator 10 may be used to apply any such liquid coating to a wide variety of objects, one specific example of such an object is shown as being a chair in FIG. 7, and another as being a window sash in FIG. 8. However, these two specific objects are provided for illustrative purposes only, and are not intended to be limitative of the scope of the appended claims.

Adverting now to FIG. 1, the improved applicator 10 is shown as broadly including a handle member, generally indicated at 11, and an applicator pad, generally indicated at 12.

Referring now to FIGS. 1, 2 and 4, the preferred form of handle member 11 is shown as being an integrally-formed plastic member having a leftward horizontal blade 13, two intermediate vertically-thickened locking bosses 14, 14, and an upwardly and rightwardly extending handle 15 provided with a through-hole 16 proximate its right marginal end and by which the applicator 10 may be hung when not in use. In the preferred embodiment, the handle 15 is vertically inclined with respect to the horizontal plane of the blade by an acute included angle of about twenty-five degrees. As best shown in FIGS. 2, 4 and 5, the blade 13 is in the form of an elongated substantially rectangular plate-like body having a rear transverse edge 17, a front transverse edge, and two longitudinally-extending left and right edges 19, 19. The forward corners between the front edge 18 and the side edges 19, 19 are shown as being rounded, and are indicated at 20, 20. The inclined elongated handle 15 extends longitudinally, centrally and rearwardly away from the blade rear edge 17, this handle having a width less than that of the blade at its juncture therewith proximate this rear edge.

The two vertically-thickened locking bosses, severally indicated at 14, extend vertically above and below the upper and lower planar surfaces 21, 22, respectively, of the blade 13 by vertical distances almost twice as great as the vertical thickness of the blade portion 13. In the preferred embodiment, the vertical thickness of the blade is about 0.045 inch, and the nominal vertical spacing between the upper and lower surfaces 23, 24 of the two locking bosses is about 0.187 inch. Therefore, the nominal vertical spacing between the blade upper surface 21 and the upper locking boss upper surface 23 is about 0.071 inch. The same is true with respect to the vertical spacing between the blade lower surface 22 and the lower locking boss lower surface 24. The longitudinal extent of each rectangular locking boss 14 is almost one-quarter of the longitudinal extent of the blade (FIG. 2). As shown, the outstanding bosses 14, 14 are arranged one above the other proximate the juncture of the blade and handle. These bosses severally have a width greater than that of the handle at its juncture with the blade, but less than that of the blade measured along its rear edge 17, so as to leave exposed marginal portions of the blade along its opposite longitudinal edges 19, 19.

The applicator pad 12 broadly includes a cellular or foam cushion 25 having upper and lower horizontal planar surfaces 26, 28, a blade receiver 29 bonded to the cushion upper surface 26, and a bristle portion 30 bonded to the cushion lower surface 28. This bristle portion may be formed from individual bristles, or may be a flocked pile material, as desired. The cushion 25 appears to be substantially parallelogram-shaped when viewed in side elevation (FIGS. 11–14), while the upper and lower surfaces 26, 28 thereof appear rectangular when viewed in top plan. (FIG. 2). As best shown in FIGS. 2, 5 and 6, the blade receiver 29 is longitudinally-elongated and is open at both ends. This blade receiver includes a rectangular horizontal web portion 31, the lower surface of which is suitably bonded to the cushion upper surface 26, an upstanding flange portion 32 extending upwardly from each longitudinal side margin of web 31, and spaced inturned flange portions 33 extending horizontally toward one another from the upper ends of the upstanding flange portions 32. The inner or downwardly facing surfaces of these inturned flanges 33 are spaced from the upwardly facing surface of web 31, at a distance shown to correspond to the vertical thickness of the plate-like body of blade 13, to provide opposing channels to receive the elongated marginal portions of this blade along its longitudinal edges 19, 19. The inturned flanges 33 terminate in opposing edges 37 spaced apart a distance at least equal to the width of either boss 14.

One advantage of the unique shape of the improved applicator pad 12 in association with its cooperative handle member 11 lies in the many versatile configurations by which such elements may be joined together, as shown in FIGS. 11–14. The handle member blade 13 is adapted to be slidably inserted into the blade receiver from either open end thereof. For convenience, the rear end of the blade receiver proximate the acute included angle of the cushion is indicated at 34, and its opposite front end proximate the obtuse included angle of the cushion is indicated at 35. Thus, the blade 13 may be inserted into the blade receiver from its rear end 34 so that the bristles or pile proximate the other acute included angle of the pad will extend beyond the blade receiver front end 35 (FIG. 11), this being useful for general painting requirements, as typically shown in FIG. 7. Alternatively, the blade 13 may be inserted into the blade receiver from its front end 35 so that the blade receiver rear end 35 will extend further than the bristles proximate the obtuse included angle of the cushion (FIG. 12). This configuration is also of general utility. In either of these configurations the blade lower surface 22 is shown as being arranged to face the blade receiver web 31.

Alternatively, the handle member may be rotated 180 degrees about its longitudinal axis and inserted into the blade receiver such that the blade upper surface 21 will be arranged to face the web. With the handle in this inverted orientation, the blade 13 may still be inserted into the blade receiver from either its rear end (FIG. 13), or its front end (FIG. 14). These two configurations are uniquely suited to painting of the back of a sash of a double hung window, as shown in FIG. 8.

Another and highly useful connection between the handle member and applicator pad is also possible. The blade 13 may be slidably inserted into the rear end of the blade receiver for a sufficient distance such that the forward edge 18 of the blade will extend forwardly beyond the cushion for a selected distance, this being shown in FIG. 10. In this configuration, the edge 18 may provide a guide which may be translated along a surface to accurately space the forward bristle edge 36 from the same or some other surface, as representatively shown in FIG. 9. Hence, this arrangement is particularly suited to painting window sashes, as illustrated in FIG. 9, or edges along corners, as shown in FIG. 10.

Adverting now to FIGS. 4 and 6, persons skilled in this art will readily appreciate that when one of the vertically-thickened locking bosses 14 is caused to enter the blade receiver, the raised planar boss surface, 23 or 24, thereof will frictionally engage the web portion 31 to prevent unintended separation of the handle member. This frictional engagement of the locking boss 14 with the blade receiver may cause some deformation of the proximate portions of the blade receiver and the cushion, as shown in FIG. 4, and functions to prevent unintended separation of the handle member from the pad. The blade receiver 29 is inherently flexible to permit such deformation.

Of course, persons skilled in this art will appreciate that various modifications may be made. For example, the handle member need not invariably be integrally formed, as in the preferred embodiment. Alternatively, the various portions of the handle member may be formed separately and subsequently assembled together. In either case, a unitary handle member is provided. Likewise, while it is presently preferred to form the handle member of a suitable plastic material, the present invention contemplates that other materials may be used. Also, while the preferred embodiment of the handle member is shown as having a locking boss 14 extending upwardly and downwardly from the upper and lower blade surfaces, respectively, either one of these could be omitted, if desired.

While the cushion is shown as being parallelogram-shaped in cross-section, such cushion could alternatively be trapezoidal, either isosceles or otherwise, or square or rectangular. In the preferred embodiment, the acute included angle of the parallelogram-shaped cushion is about thirty degrees, although this could readily be modified, as desired.

Therefore, while a preferred embodiment of the present invention has been shown and described, and several modifications thereof discussed, persons skilled in this art will appreciate that various additional modifications and changes may be made without departing from the spirit of the invention, which is generically defined by the following claims.

What is claimed is:

1. An applicator for use in applying a liquid coating, such as paint, to an object comprising:

an invertible unitary handle member including a blade having an elongated substantially rectangular plate-like body having opposite planar surfaces, an elongated handle extending longitudinally and centrally from one end of said blade and inclined to such blade surfaces, and a similar boss outstanding from each of said blade surfaces proximate the juncture of said blade and handle and having a raised surface space from the corresponding one of said blade surfaces a distance more than the thickness of said blade and having a width greater than that of said handle at said juncture but less than that of said blade leaving exposed marginal portions of said plate-like body; and an end-for-end reversible elongated applicator pad including a cushion having opposite surfaces, bristle means on one such cushion surface, and an elongated open-ended flexible blade receiver having a web portion secured to the other such cushion surface, an outstanding flange portion extending along each longitudinal margin of said web portion, and spaced inturned flange portions extending toward each other from the outer margins of said outstanding flange portions and each having an inner surface opposing said web portion and spaced therefrom a distance corresponding to the thickness of said plate-like body to provide opposing channels for receiving said marginal portions, said inturned flange portions terminating in opposing edges spaced apart a distance at least equal to the width of either of such bosses;

whereby, said blade is insertable into either open end of said receiver and slidable therealong with that one of said bosses facing said web portion being adapted to engage and deform the same to frictionally hold the handle member in a desired longitudinal position on said applicator pad.

* * * * *